US005120289A

United States Patent [19]

Yu

[11] Patent Number: 5,120,289

[45] Date of Patent: Jun. 9, 1992

[54] CONVERTIBLE GYMNASTIC APPARATUS FOR DOING PUSH-LIFT MOVEMENT OR CHEST BUILDING MOVEMENT

[76] Inventor: James Yu, No. 1371-5, Chung Shan Rd., Shen Kang Hsiang, Taichung Hsien, Taiwan

[21] Appl. No.: 760,918

[22] Filed: Sep. 17, 1991

[51] Int. Cl.[5] ..... A63B 21/06

[52] U.S. Cl. ..... 482/137; 482/100; 482/136; 482/138

[58] Field of Search ..... 482/97, 98, 99, 100, 482/135, 136, 137, 138

[56] References Cited

U.S. PATENT DOCUMENTS

| | | | |
|---|---|---|---|
| 3,912,261 | 10/1975 | Lambert, Sr. | 482/136 X |
| 4,390,179 | 6/1983 | Szkalak | 482/138 X |
| 4,505,475 | 3/1985 | Olschansky et al. | 482/138 X |
| 4,757,992 | 7/1988 | Heitsch et al. | 482/136 |
| 4,799,670 | 1/1989 | Williamson | 482/136 X |
| 4,809,972 | 3/1989 | Rasmussen et al. | 482/138 X |
| 4,817,943 | 4/1989 | Pipasik | 482/137 X |
| 4,844,456 | 7/1989 | Habing et al. | 482/100 |
| 4,915,379 | 4/1990 | Sapp | 482/138 |
| 4,949,951 | 8/1990 | Deola | 482/138 |
| 4,964,632 | 10/1990 | Rockwell | 482/100 |
| 4,986,538 | 1/1991 | Ish. III | 482/138 |

FOREIGN PATENT DOCUMENTS

| | | | |
|---|---|---|---|
| 2581550 | 11/1986 | France | 482/137 |
| 2029244 | 3/1980 | United Kingdom | 482/137 |

*Primary Examiner*—Robert Bahr
*Attorney, Agent, or Firm*—Bacon & Thomas

[57] ABSTRACT

A convertible gymnastic apparatus for doing push-lift movement or chest building movement makes use of a short cross bar having thereon a protruded bar extending upwardly and a swing frame comprising a longitudinal bar, to which a movable body is attached, and two gyrating arms having a baffle disposed at inner side end thereof. As movable body is moved upwardly, the movement of the baffle of gyrating arm is obstructed by the bump of the movable body so that the gyrating arm can not be rotated. Therefore, the user can do the push-lift movement. As movable body is moved downwardly, the protruded bar of the short cross bar is locked securely into the hole of the movable body, thereby resulting in prevention of the swing frame from swinging forward and allowing the user to do the chest building movement.

2 Claims, 6 Drawing Sheets

CONVERTIBLE GYMNASTIC APPARATUS FOR DOING PUSH-LIFT MOVEMENT OR CHEST BUILDING MOVEMENT

BACKGROUND OF THE INVENTION

The present invention relates to a gymnastic apparatus having improved means convertible speedily for doing the push-lift movement or the chest building movement.

As shown in FIG. 1, a conventional gymnastic apparatus 1 of the prior art comprises a push-lift means 11 and a chest building means 12 located respectively at both ends thereof. Such gymnastic apparatus is defective in that it is bulky in size and that is made up of many components.

Another category of the gymnastic apparatus 2, as shown in FIG. 2, is composed of a push-lift means 21 and a chest building means 22, which are both disposed at one end thereof. As shown in FIG. 3, two gyrating arms 24 of the chest building means 22 are respectively secured to the gymnastic apparatus by means of two bolts 23. The user of such gymnastic apparatus is permitted to do the push-lift movement by pushing forward the gyrating arms 24 to actuate the swing frame 25 of the push-lift means 21 to swing forward when two gyrating arms 24 are locked so as to be unable to rotate horizontally. As long as these two gyrating arms 24 are not locked by the bolts 23, the user of the gymnastic apparatus can force the gyrating arms 24 to rotate horizontally in order to do the chest building movement.

It is quite apparent by now that the user of such gymnastic apparatus of the prior art must take trouble to adjust the bolts 23 each time when he or she wishes to do the push-lift movement or the chest building movement. In addition, such gymnastic apparatus is not provided with means, which prevents the swing frame 25 from swinging forward at the time when the user is doing the chest building exercise.

SUMMARY OF THE INVENTION

It is therefore the primary objective of the present invention to provide the gymnastic apparatus with means permitting the user thereof to do the push-lift movement or the chest building movement at will.

In keeping with the principles of the present invention, the primary objective of the present invention is accomplished by a gymnastic apparatus, which comprises mainly a base, a swing frame, two gyrating arms, and a movable body. The base includes a front frame having at upper end thereof a short cross bar which protrudes forward and consists of a protruded bar facing upwardly. The front frame further comprises at top end thereof a long cross bar extending forward. The swing frame is pivotally fastened at the top end thereof to the front end of the long cross bar and is composed of two horizontal segments extending sidewards. Located at the center of the space between these two horizontal segments is a longitudinal bar of an appropriate length extending downwardly. Two gyrating arms capable of rotating horizontally are respectively and pivotally fastened through pivotal shafts thereof to the outer ends of the horizontal segments of the swing frame. Each of the two gyrating arms is respectively provided with a force receiving segment extending downwardly and with a semi-circular guide rail located at the rear end thereof. The guide rail further comprises at outer side thereof a steel cable intended to move the weights and is also composed of a baffle disposed at the inner side end thereof. The movable body is arranged at the rear end of the longitudinal bar and is capable of moving longitudinally in the longitudinal bar before being locked in by a fastening means. The movable body comprises a bump serving to obstruct the baffle of the gyrating arm so that the gyrating arm can not be rotated when the force has not been ezerted on the gyrating arm. The movable body further comprises a plurality of holes located at the rear end thereof. The protruded bar of the short cross bar is received in the hole of the movable body at the time when the movable body moves downwardly until the position of top end of the bump is lower than that of the bottom end of the baffle of the gyrating arm, thereby resulting in the swing frame incapable of swinging forward. Therefore, the user of the convertible gymnastic apparatus of the present invention is able to make a fast conversion for doing push-lift movement or chest building movement.

DETAILED DESCRIPTION OF THE PREFERRED EMBODIMENT

Figure 1:
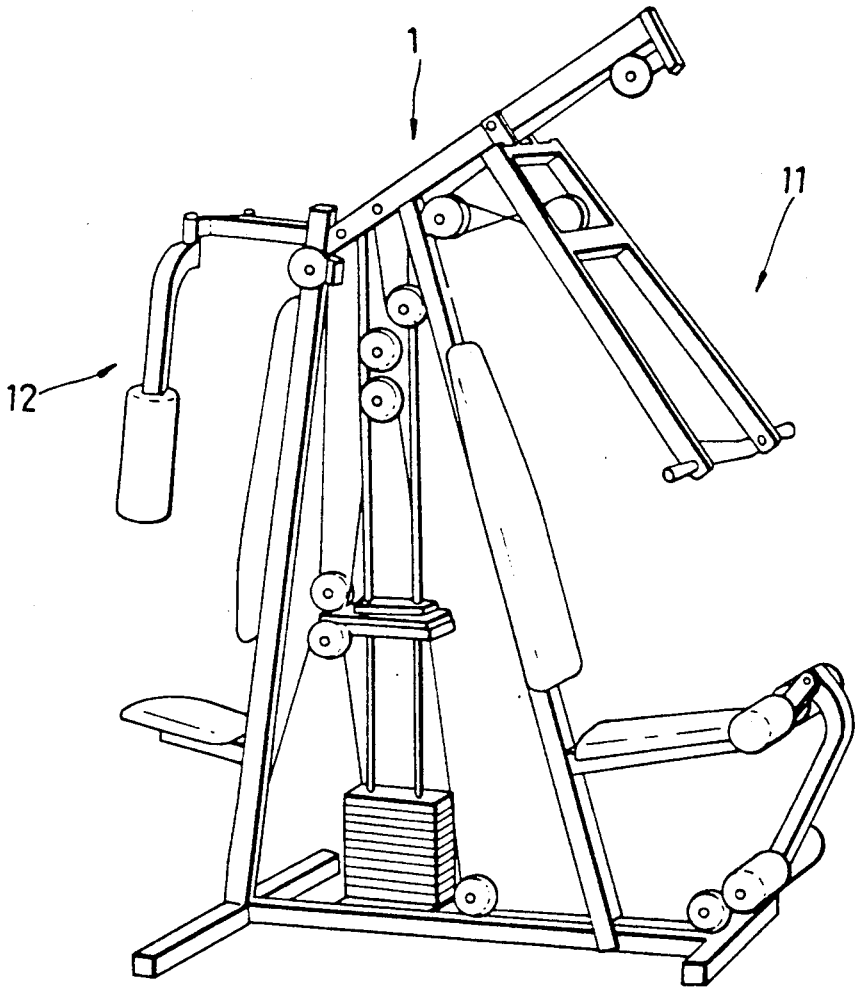
PRIOR ART FIG. 1
FIG. 1 shows an external view of the prior art gymnastic apparatus.
Figure 2:
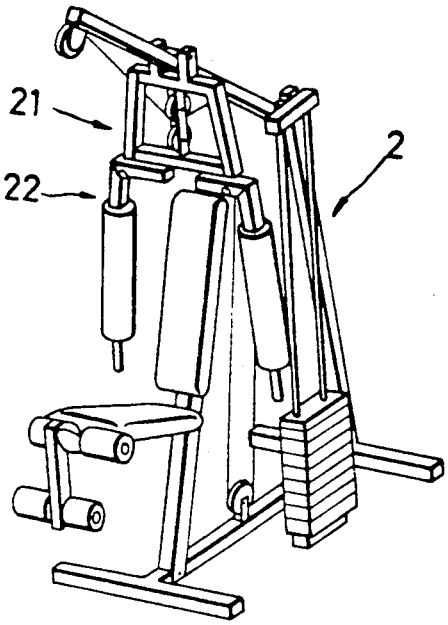
PRIOR ART FIG. 2
FIG. 2 shows an external view of another gymnastic apparatus of the prior art.
Figure 3:
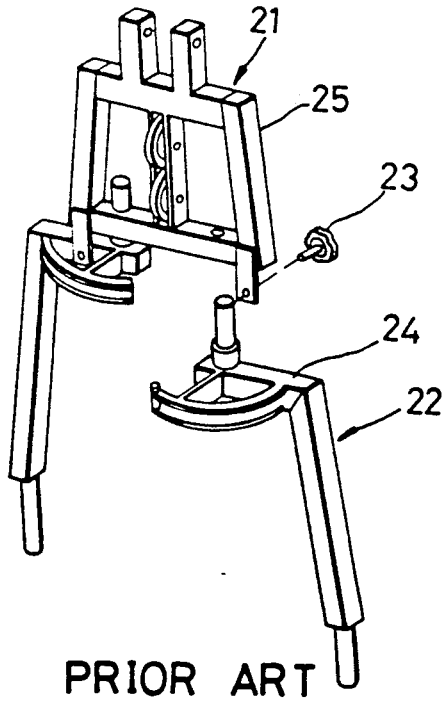
PRIOR ART FIG. 3
FIG. 3 shows some of the components making up the prior art gymnastic apparatus as shown in FIG. 2.
Figure 4:
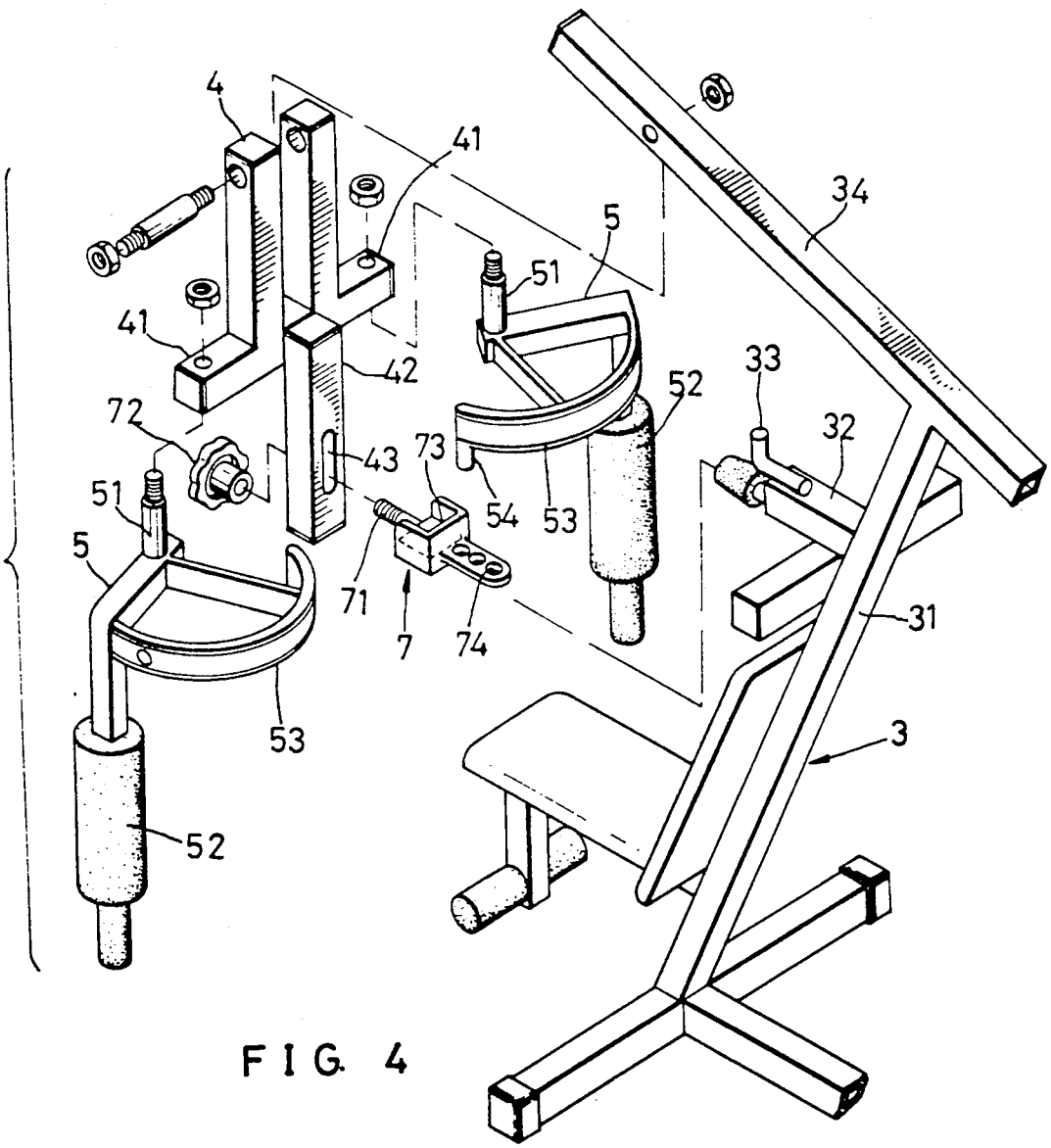
FIG. 4 shows an exploded view of the preferred embodiment of the present invention.
Figure 5:
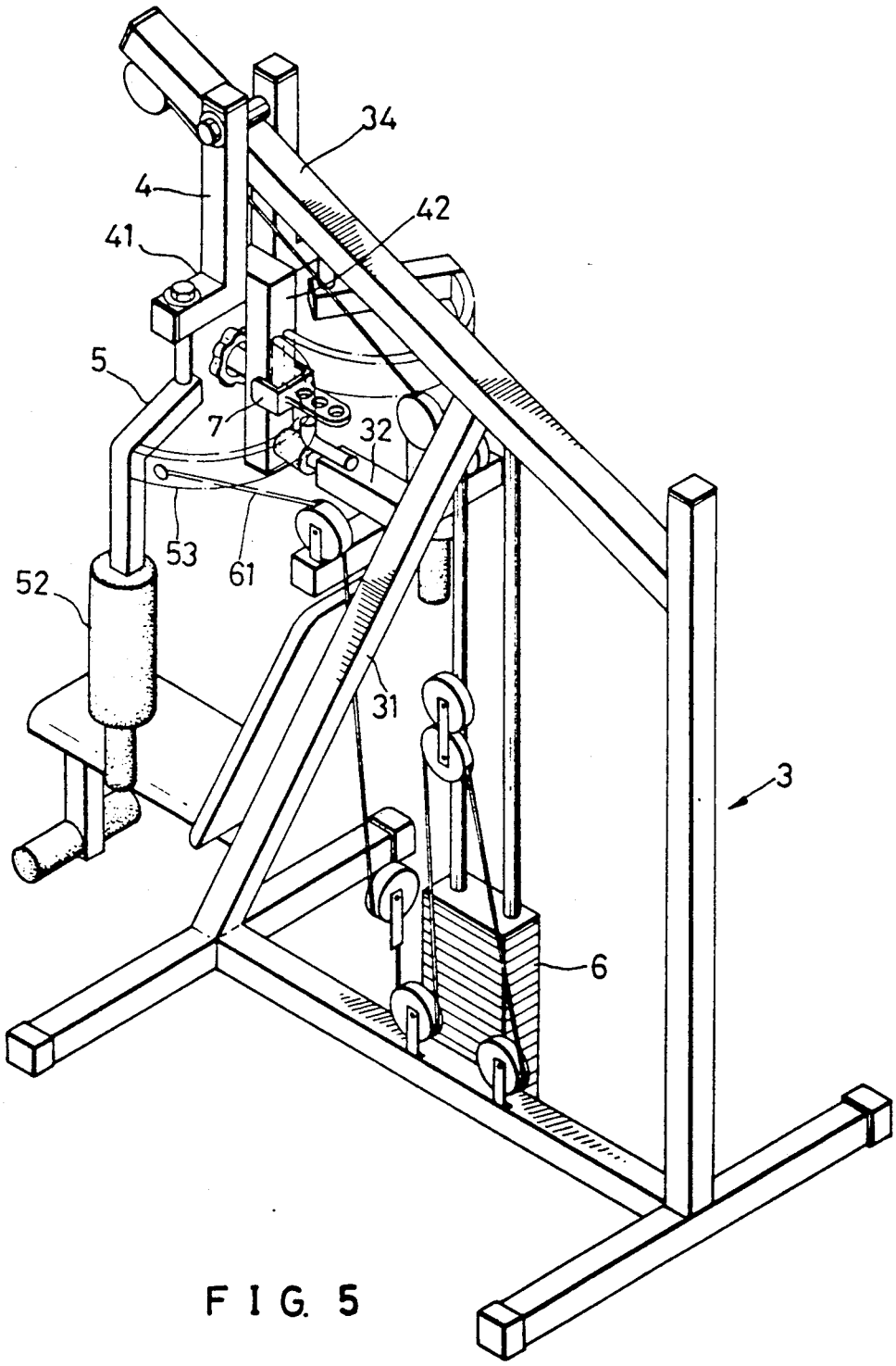
FIG. 5 shows an external view of the preferred embodiment of the present invention.

Referring to FIGS. 4 and 5, the gymnastic apparatus embodied in the present invention is shown comprising a base 3 made up of a plurality of rod bodies. The front frame 31 of the base 3 comprises in the vicinity of the top end thereof a short cross bar 32 extending forward, which in turn comprises thereon a protruded bar 33 extending upwardly. Attached to the top end of the front frame 31 is a long cross bar 34 extending forward.

Located the near front end of the long cross bar 34 is a swing frame 4, which is pivotally fastened to the long cross bar 34 and is provided with two horizontal segments 41 of an appropriate length extending sideways respectively. Located at the center of the space between the two horizontal segments 41 is a longitudinal bar 42 of an appropriate length, which extends downwardly and comprises a longitudinal hole 43 passing through both front and rear sides thereof.

Two gyrating arms 5 are respectively fastened to the outer end of each of the two horizontal segments 41 by means of pivotal shafts 51 thereof. Each of the two gyrating arms 5 is composed of a force receiving segment 52 located at the outer side thereof and extending downwardly. Each gyrating arm 5 is further provided at the rear side thereof with a semi-circular guide rail 53 which in turn comprises at the outer side thereof a steel-cable 61 intended to move the weights 6. The guide rail 53 further includes a baffle 54 located at the innerside end thereof and extending downwardly.

Figure 6:
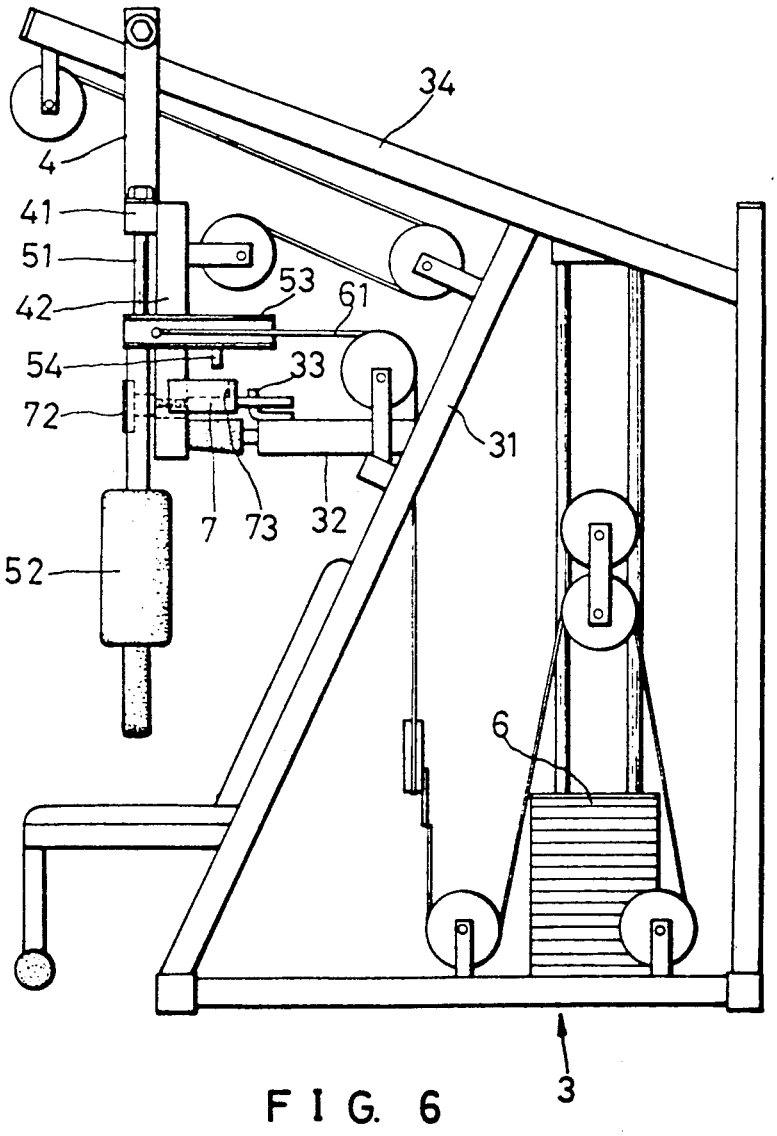
FIG. 6 shows a side view of the preferred embodiment of the present invention when it is used for doing the chest building exercise.
Figure 7:
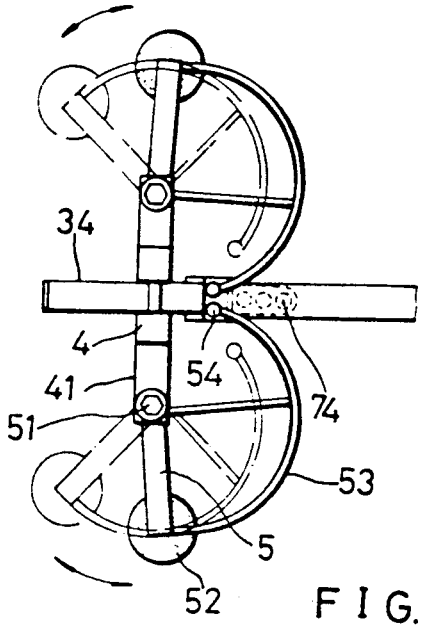
FIG. 7 shows a schematic view of the chest building movement according to the present invention.
Figure 8:
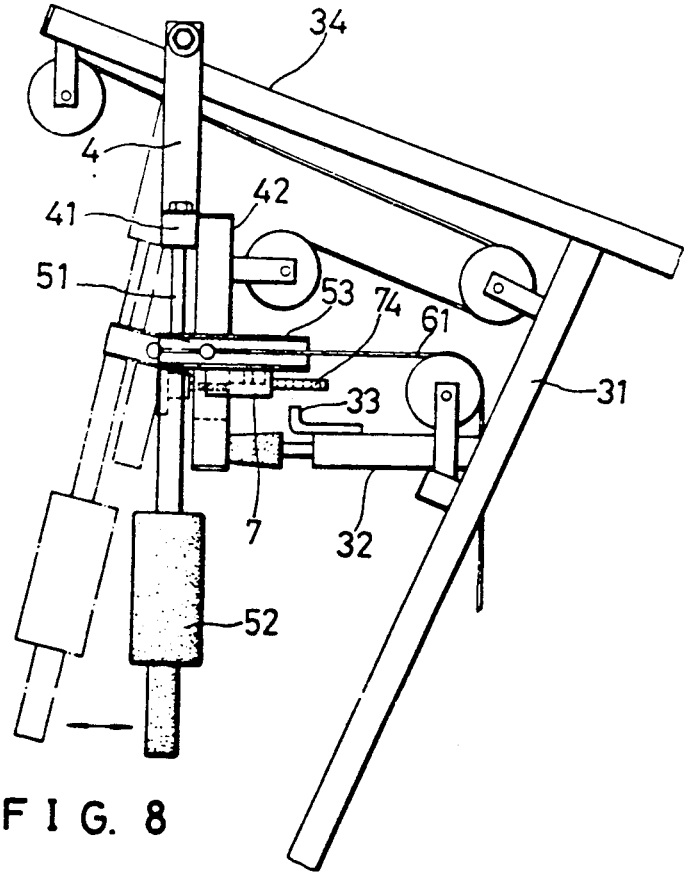
FIG. 8 shows a schematic view of the push-lift movement according to the present invention.

The longitudinal bar 42 comprises at the rear end thereof a movable body 7 having a threaded rod 71 disposed at the front end thereof. The threaded rod 71 passes through the longitudinal hole 43 of the longitudinal bar 42 and can be fastened securely to the longitudinal bar 42 at a specific position along the longitudinal hole 43. The movable body 7 also consists of a bump 73, which remains in such a state, as shown in FIG. 8, when the gyrating arm 5 is not exerted upon by the force. As movable body 7 moves upwardly to obstruct the baffle 54 of the gyrating arm 5 so as to prevent the gyrating arm 5 from rotating, the user of the gymnastic apparatus can exert the force on the force receiving segment 52 to do the push-lift movement. The movable body 7 further comprises at the rear end thereof three holes 74 arranged in a row. As movable body 7 moves downwardly, as shown in FIG. 6, to the extent that the position of the top end of the bump 73 is lower than the bottom end of the baffle 54 of the gyrating arm 5, the protruded bar 33 of the short cross bar 32 is caught in one of the three holes 74. As a result, the swing frame 4 can not be swung forward. Accordingly, the user can do the chest building movement, as shown in FIG. 7.

It has now become apparent that the user of the gymnastic apparatus of the present invention can do at will and with ease either the push-lift movement or the chest building movement by loosening slightly the nut 72 to move upwardly or downwardly the movable body 7 so as to permit the bump 73 to obstruct the movement of the baffle 54 of the gyrating arm 5, or to permit the protruded bar 33 of the short cross bar 32 to be locked into the hole 74 of the movable body 7.

The embodiment of the present invention described above is to be considered in all respects as merely an illustration of principles of the present invention. Accordingly, the present invention is to be limited only by the scope of the hereinafter appended claims.

I claim:

1. A convertible gymnastic apparatus for doing push-lift movement or chest building movement comprising:

(a) a base including a front frame having in the vicinity of upper end thereof a short cross bar which protrudes forward and consists of a protruded bar facing upwardly, said front frame further comprising at top end thereof a long cross bar extending forward;

(b) a swing frame being pivotally fastened at the top end thereof to the front end of said long cross bar and composed of two horizontal segments extending sidewards, with a longitudinal bar extending downwardly and located centrally between said two horizontal segments;

(c) two gyrating arms capable of rotating horizontally and being respectively and pivotally fastened through pivotal shafts thereof to the outer ends of said horizontal segments of said swing frame, with each of said gyrating arms being provided with a force receiving segment extending downwardly and with a semi-circular guide rail disposed at the rear end thereof, said guide rail further consisting of a steel cable located at outer side thereof and a baffle arranged at the inner side end thereof; and (d) a movable body arranged at the rear end of said longitudinal bar and composed of a bump serving to obstruct the movement of said baffle and of a plurality of holes arranged in a row and located at the rear end thereof so as to receive thereinto said protruded bar of said short cross bar in such a manner that the forward swinging of said swing frame is effectively prohibited.

2. A convertible gymnastic apparatus for doing push-lift movement or chest building movement according to claim 1, wherein said longitudinal bar comprises a longitudinal hole passing through both front and rear sides thereof, and wherein said movable body comprises at front end thereof a threaded rod extending through said longitudinal hole to engage with a nut.

* * * * *